United States Patent [19]

Bordini

[11] Patent Number: 4,784,697

[45] Date of Patent: Nov. 15, 1988

[54] METHOD AND AN ARRANGEMENT ON PACKING MACHINES

[75] Inventor: Giorgio Bordini, S. Prospero, Italy

[73] Assignee: Tetra Dev-Co., Modena, Italy

[21] Appl. No.: 13,052

[22] Filed: Feb. 10, 1987

[30] Foreign Application Priority Data

Feb. 14, 1986 [IT] Italy ..... 19421 A/86

[51] Int. Cl.[4] ..... B08B 9/06; B65B 9/08

[52] U.S. Cl. ..... 134/22.15; 134/24; 134/166 C; 53/426; 53/451; 53/551

[58] Field of Search ..... 53/551, 552, 426, 451; 134/22.15, 24, 26, 30, 166 C

[56] References Cited

U.S. PATENT DOCUMENTS

| | | | |
|---|---|---|---|
| 2,918,770 | 12/1959 | Stocker | 53/551 |
| 3,457,968 | 7/1969 | Tuma . | |
| 3,615,823 | 10/1971 | Tuma et al. | 134/24 |
| 3,677,272 | 7/1972 | Schrank et al. | 134/166 C X |
| 3,911,642 | 10/1975 | Ernstsson et al. | 53/426 |
| 3,912,535 | 10/1975 | Rauser | 53/551 X |
| 3,970,426 | 7/1976 | Stark et al. . | |
| 4,055,035 | 10/1977 | Sjostrand et al. . | |
| 4,218,265 | 8/1980 | Fuchs et al. . | |
| 4,547,339 | 10/1985 | McClure | 134/22.15 X |
| 4,606,174 | 8/1986 | Berg | 53/551 X |
| 4,608,810 | 9/1986 | Bordini | 53/551 |

FOREIGN PATENT DOCUMENTS 2145528 2/1973 France .

*Primary Examiner*—Horace M. Culver

*Attorney, Agent, or Firm*—Burns, Doane, Swecker & Mathis

[57] ABSTRACT

In packing machines which produce aseptic packing containers for e.g. foodstuffs, it is of greatest importance that the machines can be cleaned and sterilized in a satisfactory manner prior to the production of packing containers. In accordance with the invention a method and an arrangement are provided on a packing machine for the sterilization of the lower end of a filling pipe 10 as well as of surrounding parts of a packing material tube 8. Use is made for this prupose of a connecting element 20 which connects two feed ducts 11,12 present in the filling pipe 10 to each other so that cleaning and sterilizing agent can circulate in the filling pipe. In a subsequent stage the connecting element 20 is removed so that sterilizing agent can be made to circulate also along the outside of the filling pipe 10 and in the packing material tube surrounding the filling pipe, whereupon the production of the packing containers commences.

14 Claims, 3 Drawing Sheets

8
10
11
12
13
14
15
18
20
22

METHOD AND AN ARRANGEMENT ON PACKING MACHINES

FIELD OF THE INVENTION

The present invention relates generally to packing machines and particularly, to a method and arrangement in a packing machine including a filling pipe having two feed ducts, wherein parts of the machine are sterilized.

BACKGROUND OF THE INVENTION

Packing machines are known which produce packing containers of the non-returnable type by converting a flexible web of packing material to a material tube, successively filling the tube with contents and sealing the same in repeated transverse sealing zones placed at uniform intervals (U.S. Pat. No. 3,325,961). In this type of machine the contents are fed via one or more feed ducts which in the form of a filling pipe extend substantially vertically downwards into the packing material tube and open at some distance from the bottom of the same, that is to say slightly above the place where the repeated transverse sealing of the downwards directed tube occurs. Thus the feed ducts as well as the outside of the filling pipe come into contact with the contents, and it is therefore very important that it should be possible to cleanse and sterilize these parts in an effective manner before the machine is started and production commences (so-called presterilization). At the same time the adjacent, inner part of the packing material tube must be sterile, and if this is the case this sterility must not be allowed to be disrupted. This means in practice that the lower part of the filling pipe surrounded by the packing material tube is not accessible for manual cleaning or sterilization from the outside.

A further difficulty is caused by the fact that the strong cleaning and sterilizing agent which has to be used for removing residues of contents and for sterilizing the internal, inaccessible parts of the feed ducts must not come into contact with the packing material tube consisting of paper or plastics, since this may then be destroyed and commence to leak so that the sterility might be lost. The sterilizing agent, moreover, is delivered to the feed ducts under high pressure which would immediately burst the tube if the sterilizing agent were to be allowed to flow into the same. None the less, the inside of the packing material tube as well as the outside of the filling pipe have to be sterilized prior to the start of production, that is to say before the packing machine is started to produce aseptic packing containers filled with sterile contents.

When a packing machine for example of the type described above is to be presterilized before the start of production, a sterilization process will have to be utilized, therefore, which involves a change from the sterilization of the feed ducts, the outside of the filling pipe and the inside of the packing material tube to a subsequent production situation without any disruption of the sterility achieved. It must be possible to carry out the transition from internal sterilization of the feed ducts to external sterilization of the filling pipe without the occurrence of a risk reinfection of the feed ducts, that is to say without their inside being brought into contact with the environment.

Earlier attempts to provide a cleaning and sterilization process on similar packing machines included dismantling of parts of the filling pipe for manual cleaning and sterilization. It was not possible during the manual mounting of the filling pipe completely to avoid the risk of reinfection.

OBJECTS AND SUMMARY OF THE INVENTION

It is an object of the present invention to provide a method for the presterilization of the filling pipe and the feed ducts of a packing machine and possibly also of adjacent parts of the machine and packing material, this method not being subject to the disadvantages which were attached to previously known, corresponding sterilization procedures.

It is a further object of the present invention to provide a cleaning and sterilization procedure which is especially applicable to packing machines of the type which comprises two feed ducts.

It is a further object of the present invention to provide a sterilization process which can be carried out in a safe and effective manner and which appreciably reduces, or completely eliminates, the risk of reinfection and non-sterility.

These and other objects have been achieved in accordance with the invention in that a method of the type mentioned in the introduction has been given the characteristic that the feed ducts are sterilized internally in that their outlet ends are connected to each other and sterilizing agent is passed through the ducts and that the filling pipe is sterilized externally by means of sterilizing agent which is introduced between the pipe and the surrounding packing material.

It is an object of the present invention, moreover, to provide an arrangement which makes it possible to realize the method in accordance with the invention with the help of simple and low-cost devices which are simple to handle and ensure a satisfactory result.

It is a further object of the present invention to provide an arrangement for the realization of the method, this arrangement comprising elements for joining together the outlet ends of the feed ducts and isolate the feed ducts from the environment, especially the surrounding packing material.

These and other objects have been achieved in accordance with the invention in that an arrangement of the type mentioned in the introduction has been given the characteristic that it comprises a connecting element joined in a detachable manner to the lower end of the filling pipe which connects the outlet ends of the feed ducts to each other.

The method and the arrangement in accordance with the invention make it possible with the help of strong cleaning and sterilizing agents and high pressure to cleanse the interior of the feed ducts without the packing material surrounding the filling pipe coming into contact with the sterilizing agent. The invention makes it possible, moreover, to change to an external sterilization of the filling pipe and a simultaneous internal sterilization of the packing material tube without a risk of reinfection of previously cleaned and sterilized parts of the feed ducts. Finally the sterilization procedure can be interrupted and a successive start of production can take place in an automated and labor-saving manner, the procedure as a whole providing very great safety and elminating the risk of non-sterile packages being produced after the start of production.

BRIEF DESCRIPTION OF THE DRAWINGS

A preferred embodiment of the method as well as of the arrangement in accordance with the invention will now be described in greater detail with specific reference to the enclosed schematic drawings which only show the details essential for an understanding of the invention.

DETAILED DESCRIPTION OF THE PREFERRED EMBODIMENT

Figure 1:
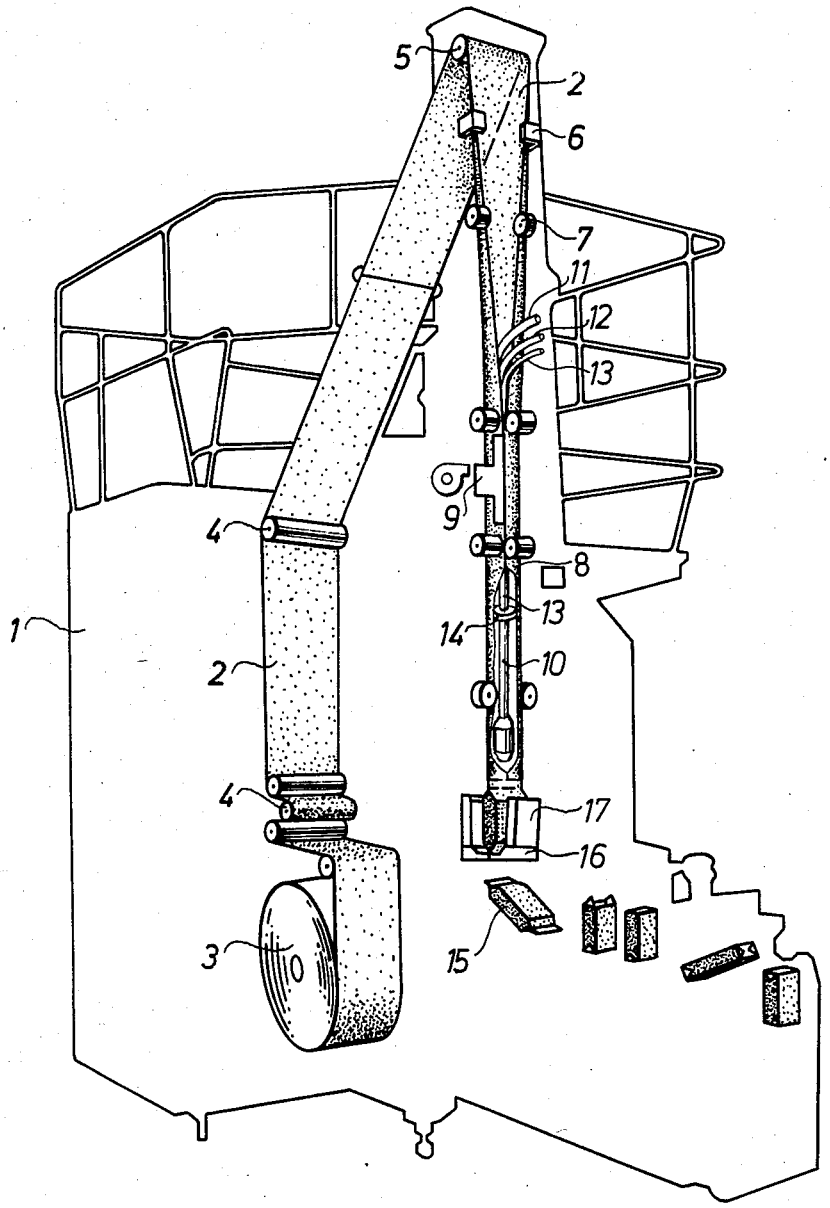
FIG. 1 is a perspective view partially in section of the principle, known in itself, of the conversion of a packing material web to tubular shape for the manufacture of filled packing containers.

The method and arrangement in accordance with the invention can be used in a number of different types of packing machines which convert packing material in the form of a web or sheets to packing containers filled with contents. However, for the sake of clearness the invention will be described in the following as constructed when it is used on a packing machine of known type, which is described in more detail in SE-PS No. 8401288-9, to which reference is made.

The packing machine 1 is fed with weblike packing material 2 which is supplied to the machine in the form of a roll 3 which is suspended so that it can freely rotate in the lower, rear part of the machine. The packing material 2 too is of known type and may consist, for example, of a laminate which comprises layers of paper, plastics and aluminum foil. The packing laminate web 2 is conducted up via a number of guide rollers 4 to the upper part of the machine where it passes over a deflection roller 5 to run subsequently substantially vertically downwards along the front part of the machine. During its downwards movement through the machine the packing material web 2 is successively converted to tubular shape which is done in that the two longitudinal edges of the packing material are folded with the help of folding elements 6 and guide rollers 7 and successively brought close to each other as the material web 2 is displaced downwards through the machine. Finally the two longitudinal edges of the packing material web will somewhat overlap each other and with the help of heating and sealing devices 9 the plastic layer of the packing material is heated along the said edges to softening temperature whereupon the edges are pressed together and cooled so that a longitudinal, liquid-tight sealing joint is formed. Thus the material web 2 has been converted to a packing material tube 8 whose lower end is liquid-tight and surrounds a filling pipe 10 which also extends vertically through the machine. The filling pipe 10, which in itself comprises a number of feed ducts 11,12 for contents, extends together with a further feed pipe 13 for sterile air through the upper, open end of the packing material tube 8. The filling pipe 10 opens at some distance above the lower, closed end of the packing material tube 8 whilst the feed pipe 13 extends down through, and opens below, a seal 14 which is located in the packing material tube 8 and which seals the lower, closed end of the latter from the upper, open end. In the closed space so formed contents can be introduced into the tube under sterile conditions by means of the filling pipe 10. The lower end of the packing material tube 8 is converted successively to individual, closed packing containers 15 with the help of sealing jaws 16 in reciprocating motion and likewise movable forming flaps 17 connected with them. The sealing jaws 16 in pairs are placed on either side of the tube and press the same together at uniform intervals so that transverse, flattened zones are produced wherein the packing material is sealed together in liquid-tight manner with the help of the heat and pressure supplied. The forming flaps 17 also operate in pairs and impart a substantially rectangular cross-sectional shape to the packing material tube 8, whereupon a further transverse sealing and a cutting off performed in the sealing zone separates the part of the packing material tube 8 which has been formed to packing containers 15 and filled with contents from the remaining part of the tube. The substantially cushionlike packing containers 15 thus formed, after undergoing possible further forming work in order to impart to them a substantially parallelepipedic shape, are ready and can be removed from the machine with the help of a conveyor, not shown.

Figure 2:
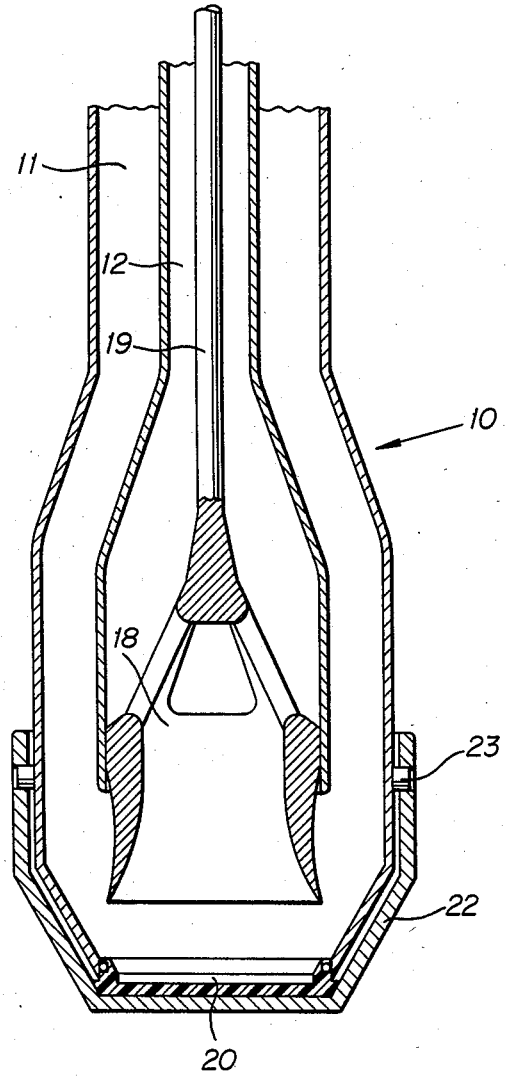
FIGS. 2 and 2A are section view of the lower end of a filling pipe including the connecting element and safety device according to the invention.
Figure 2A:
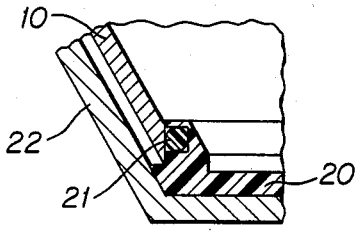

In FIG. 2 is shown the lower end of the filling pipe 10 in section. The two feed ducts 11,12 are situated concentrically inside each other, the inner feed duct 12 being intended to supply contents in liquid form, whilst the outer, annular feed duct 11 is intended to supply contents which comprise particles or fibres, e.g. lumps of fruit or meat. At the lower end of the filling pipe 10 there is, moreover, a tubular valve body 18 which is vertically displaceable in the lower end of the inner feed duct 12 by means of a maneuvering rod 19 extending vertically upwards whose upper end is connected to a driving device, e.g. a pneumatic cylinder (not shown). The tubular valve body 18 permits free passage of the liquid fluid via the inner feed duct 12 and out through the lower end of the latter via the valve body 18. However, when the valve body 18 is displaced downwards to its closed position it will block the annular opening of the outer feed duct 11 and the valve body 18 in this position prevents a flowing out of contents from the feed duct 11.

When the packing machine is to be presterilized with the help of the method and arrangement in accordance with the invention a detachable connecting element 20 which is in the shape of a cap or a plug is present at the lower end of the filling pipe 10 which with the help of an O-ring 21 extending around the periphery rests against the outlet of the feed duct 11 and is retained in the same. The connecting element 20 rests with its lower surface against a cup-shaped safety device 22 which with the help of a bayonet joint 23 is joined to, and encloses, the lower end of the filling pipe 10. When the safety device 22 has been fitted manually with the help of the bayonet joint to the lower end of the filling pipe 10 it will support the connecting element 20 and prevent it from being removed from the outlet on the delivery duct 11, e.g. owing to pressure effects from the interior of the filling pipe 10. The connecting element 20 as well as the safety device 22, just as the filling pipe 10, are appropriately made of a durable and corrosion-resistant material, e.g. stainless steel.

When the packing machine is in operation and, in accordance with known principles, converts the packing material web 2 to wholly or partially filled packing containers 15, the contents are supplied via the two feed ducts 11,12. Through the inner duct 12 a more or less continuous flow of liquid contents is supplied which pass through the valve body 18 and discharge into the lower end of the packing material tube 8 irrespectively of the position of the valve body 18. Via the outer feed duct 11 thicker contents which, for example, may contain particles of fruit pulp, are supplied. These thicker contents are delivered in portions in that the valve body 18 is moved upwards and downwards in rhythm with the advance of the packing material tube 8 and the transverse sealing off of the packing containers 15. In the upper position of the valve body 18 the contents can flow out freely via the feed duct 11 through the lower end of the filling pipe 10 during a limited time of the package formation. To ensure that contents in particle form do not get stuck in transverse seals of the tube, the flow of contents via the feed duct 11 is interrupted, however, in good time before such a seal is to take place in that the valve body 18 is displaced into a lower position (not shown) where its front end shuts off the outlet of the feed duct 11 and prevents further outflow of contents via the feed duct 11. The liquid contents, though, in spite of this can flow unhindered down into the packing material tube.

During production of packing containers the connecting element 20 as well as the safety device 22 are thus removed from the lower end of the filling pipe 10. These two devices, 20,22, are used only when the packing machine is to be cleaned and sterilized with the help of cleaning and sterilizing agents well-known in the trade, e.g. hot steam and hydrogen peroxide. The cleaning and sterilizing procedure in accordance with the invention will be described in more detail in the following with special reference to FIG. 3 which shows schematically the different phases of the process in FIGS. A–E. In FIG. 3 the filling pipe 10 is shown in section and the packing material tube 8 is indicated by means of dash-dotted lines. The reference designations correspond to those indicated in FIGS. 1 and 2.

Figures 3A, 3B, 3C, 3D, 3E:
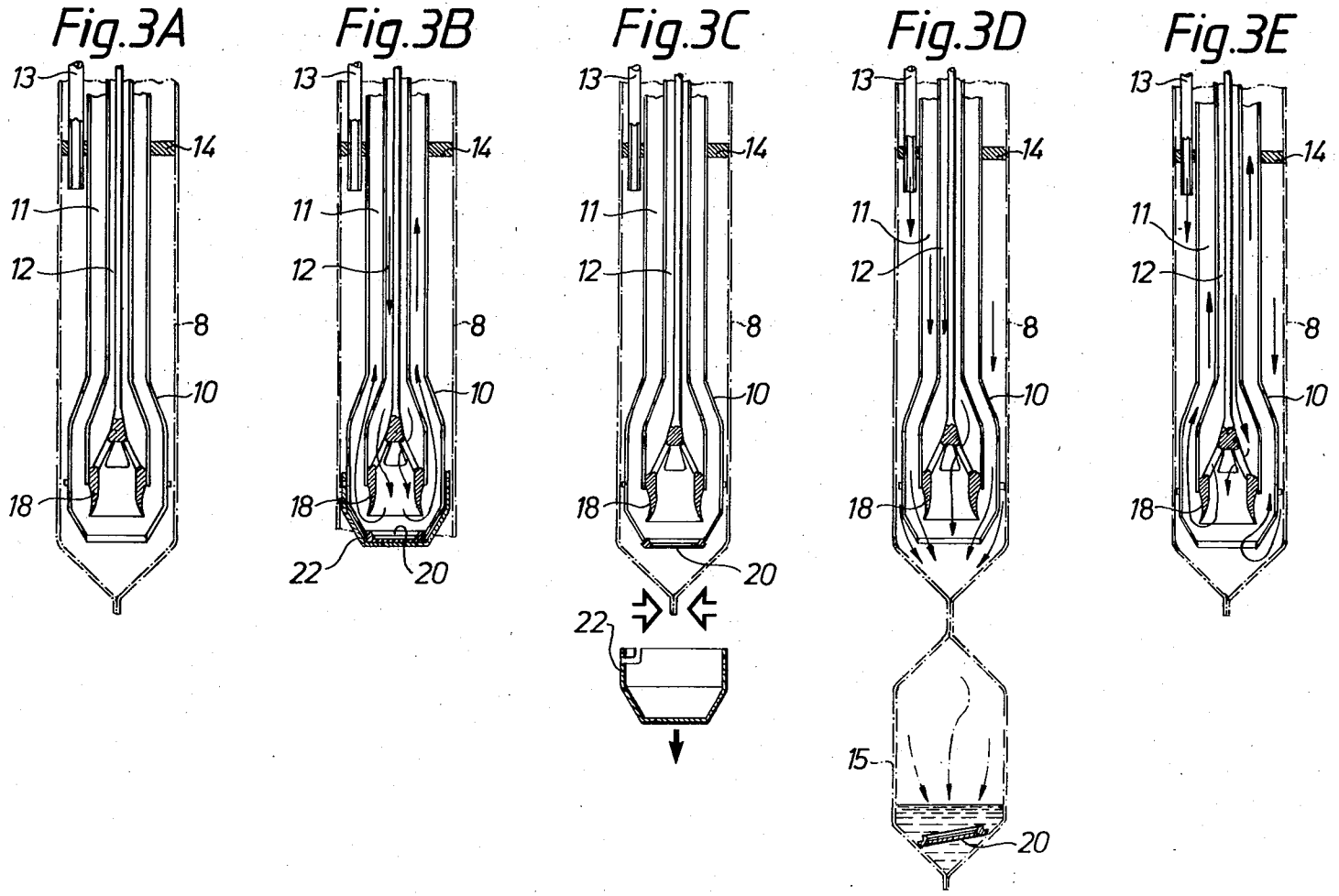
FIGS. 3 A–E are schematic views illustrating the successive procedure for the performance of a presterilization in accordance with the method of the invention.

In FIG. 3A is shown schematically the lower end of the filling pipe 10 and the surrounding packing material tube 8 in the position they assume when the production of packing containers has been completed. The packing material tube 8 surrounds the whole length of the filling pipe 10 and is sealed in a liquid-tight manner at its lower end. The end of the tube 8, that is to say the part of the tube located below the seal is empty and the two feed pipes 11,12 too have been emptied of contents in connection with the stoppage of the machine.

When the packing machine is to be started again an accurate cleaning and sterilization of the inside of the filling pipe is required, that is to say of the two feed ducts 11,12 and the part of the outside of the filling pipe 10 which can come into contact with the contents, that is to say the part located below the seal 14. The part of the packing material tube too which surrounds the filling pipe 8 has to be sterilized in order to ensure aseptic conditions when the machine is to be restarted and is to commence producing aseptic packing containers for sterile contents.

To make possible an internal cleaning and sterilization of the two feed ducts 11 the lower, sealed part of the packing material tube 8 is first removed so that the lower end of the filling pipe 10 becomes accessible from the outside. The lower end of the filling pipe is now provided with the connecting element 20 which, as mentioned previously, is in the form of a plug or a cap which is inserted in the outlet of the feed duct 11 and is retained there in a sealing position with the help of an O-ring resting against the edge of the outlet. A pure friction engagement naturally can be made use of or else spring-loaded hooks or the like can be provided so as to retain the connecting element 20 securely at the lower end of the filling pipe 10. When the connecting element 20 is placed in position the lower end of the filling pipe 10 is provided with the cup-shaped safety device 22 which is connected mechanically by hand to the filling pipe 10 with the help of a bayonet joint 23. When the safety device 22 has been applied its internal lower surface will come to rest against, and support, the connecting element 20 so that the latter sits immovably in the outlet of the feed duct 11 and in this position where it forms a complete seal, it can resist high internal pressures in the filling pipe 10 and thus prevent pressure damages on the packing material surrounding the filling pipe.

Through application of the connecting element 20 a closed connection is provided between the two feed ducts 11,12 at the lower end of the filling pipe 10, that is to say the outlet ends of the two feed ducts 11,12 will be connected to each other at the same time as they are screened off from the surrounding packing material tube and the outside of the filling pipe 10. As a result it becomes possible to circulate cleaning as well as sterilizing agent through the two feed ducts 11,12 without the packing material tube or other parts in the environment being damaged.

For the internal sterilization of the filling pipe 10 hot steam is used which after the application of the connecting element 20 and the safety device 22 is made to flow down through the inner feed duct 12, out through the open valve body so as to be conducted by the connecting element 20 sideways and up through the coaxial, outer feed duct 11 (FIG. 3B). This combined cleaning and sterilization is allowed to continue until any residues of contents have been flushed out and the filling pipe 10 as a whole has been heated to such a temperature that all bacteria have been rendered innocuous. The steam is supplied under a pressure which is such that it is capable of penetrating also into the smallest recesses which are present in the filling pipe. During this operation the connecting element 20 is held in position with the help of the safety device 22 which is designed so as to withstand the high pressure which arises in the filling pipe in the course of the circulation of steam. The steam is produced in a steam generator connected to the packing machine and is conducted via the existing valves for the contents and the existing contents ducts to the lower end of the filling pipe 10. When the steam circulation has proceeded for the required time it is interrupted and the feed ducts and the filling pipe 10 are cooled which can be done with the help of sterile condensed water or cold sterile air which is allowed to circulate for the required time in the filling pipe. Subsequently the external, cup-shaped safety device 22 is removed by hand and the packing material tube 8 is pulled down and sealed with the help of sealing jaws 16 of the packing machine in a liquid-tight seal below the lower end of the filling pipe 10 (FIG. 3C).

When the lower end of the packing material tube 8 has been closed the machine is started and allowed to manufacture a number of packages (10–15 off) without any supply of contents whilst condensed, sterilized water or sterile air is introduced into the packing material tube via the two feed ducts 11,12 as well as the feed pipe 13 (FIG. 3D). In the course of this the medium flowing through the feed pipe will press out the connecting element 20 from the outlet of the pipe 10 so that it falls down and ends up in the first-produced packing container 15 together with sterile air and a certain amount of condensed or sterilized water (FIG. 3D).

When the system has been emptied of condensed air or sterilized water and only sterile air is packed in the packing containers produced the machine is stopped again in such a position that the packing material tube 8 is closed off by a transverse, liquid-tight seal. Subsequently a sterilizing agent in vapour or gas form is introduced into the lower end of the packing material tube via the inner feed duct 12 and the feed pipe 13. The sterilizing agent can flow out again from the packing material tube via the open valve 18 and the outer feed duct 11. In this situation a simultaneous sterilization of the two feed ducts 11,12, the external parts of the filling pipe 10, the valve body 18 and of the internal parts of the lower part of the packing material tube 8 isolated by means of the seal 14 takes place. Sterilizing agent flows through the said parts during the required time, whereupon the sterilization process is interrupted, the packing machine is started and the sterile contents are delivered via the two feed ducts 11,12 in conventional manner. The cleaning and sterilizing process is thus completed and the packing machine can produce again aseptic packing containers which are wholly or partially filled with sterile contents.

The method and the arrangement in accordance with the invention can be modified in different ways to adapt them to various types of packing machines and above all to various types of filling pipes. In packing machines which comprise non-concentric filling pipes the connecting element may be, for example, in the form of a cup or a U-shaped pipe and in the case of filling pipes with a different number of feed ducts or different design it is also possible, while retaining the function, to construct the connecting element in a suitable manner. This is also the case if, for example, the valve body 18 or the valve arrangement as a whole has been designed differently and it will be possible, whilst retaining the principle of the invention, to construct the connecting element in such a manner that it can be adapted to any known type of filling pipe. The important point is only that the connecting element should be removable in spite of the packing material tube hindering direct accessibility, that is to say without manual intervention being required. The removal of the connecting element can be performed, as mentioned earlier, on account of the pressure difference on both sides of the connecting element, that is to say the increased pressure in the feed ducts, but it is also possible to remove the connecting element with the help of the valve body which is moved to such a position that it pushes the connecting element out of the filling pipe or with the help of some other mechanically acting device.

The method in accordance with the invention can also be modified by making use of alternative flow paths. In the FIGS. 3B and 3E it is possible, for example, instead of the flow paths indicated by arrows to allow the cleaning or sterilizing agent to flow in opposite directions. The type of cleaning and sterilizing agent too can be varied. The main thing is only that agents which are harmful to the packing material do not come into contact with the same and that it is not subjected to harmful pressure differences.

Trials in practice have confirmed that the object of the invention is achieved through cleaning and sterilization in stages, where each stage successively leads up to a complete sterilization of the filling pipe as well as the packing material tube without the risk of reinfection between stages.

While this invention has been illustrated and described in accordance with a preferred embodiment, it is recognized that variations and changes may be made and equivalents employed herein without departing from the invention as set forth in the claims.

What is claimed is:

1. In a method for sterilizing parts of a packing machine of the type wherein packing material is shaped and filled with contents through a pipe having two feed ducts, the steps of:

internally sterilizing the insides of the feed ducts by connecting the outlet ends of the feed ducts to each other to form a closed flow path and passing a sterilizing agent through the closed flow path, and thereafter interrupting the flow path and externally sterilzing the outside of the filling pipe by introducing a sterilizing agent between the pipe and the material which surrounds the pipe and which extends substantially vertically and has a closed lower end, wherein during the internal sterilization the feed ducts are connected to each other by means of a connecting element which is detached from the filling pipe when the connecting is interrupted and is placed into the packing material tube, the connecting element being detached with the help of a pressure difference created between the two sides of the element.

2. In a method for sterilizing parts of a packing machine of the type wherein packing material is shaped and filled with contents through a pipe having two feed ducts, the steps of:

internally sterilizing the insides of the feed ducts by connecting the outlet ends of the feed ducts to each other by means of a connecting element to form a closed flow path and passing a sterilizing agent through the closed flow path, and thereafter interrupting the flow path by detaching the connecting element from the outlet ends of the feed ducts and placing the connecting element into the packing material tube, and externally sterilizing the outside of the filling pipe by introducing a sterilizing agent between the pipe and material surrounding the pipe.

3. The method in accordance with claim 2, wherein a first sterilizing agent is used for the internal sterilization of the feed ducts and a second sterilizing agent is used for the external sterilization of the filling pipe.

4. The method in accordance with claim 3, wherein the first sterilizing agent is steam.

5. The method in accordance with claim 3, wherein the second sterilizing agent is hydrogen peroxide.

6. In a packing machine of the type wherein packing material is shaped and filled with contents, an arrangement comprising:

a filling pipe having a lower end and including two feed ducts, said feed ducts having outlet ends, a connecting element joined to said lower end of said filling pipe and connecting said outlet ends of said feed ducts to each other, and detachment permitting means for permitting the connecting element to detach from the lower end of the filling pipe when a pressure in the filling pipe exceeds a predetermined value.

7. The arrangement in accordance with claim 6, wherein said feed ducts are formed concentrically one inside of the other and said connecting element is in the shape of a plug placed in the outlet end of the outer feed duct.

8. The arrangement in accordance with claim 6, further comprising a safety device in locking engagement with said filling pipe and against which said connecting element rests.

9. The arrangement in accordance with claim 6, wherein the connecting element interrupts a connection between the outlet ends of the feed ducts and a packing material tube surrounding the filling pipe.

10. The arrangement in accordance with claim 7, wherein the plug shaped connecting element is in friction engagement with the filling pipe, said friction engagement forming said detachment permitting means.

11. The arrangement in accordance with claim 7, wherein the plug shaped connecting element is in spring engagement with the filling pipe, said spring engagement forming said detachment permitting means.

12. In a method for sterilizing parts of a packing machine of the type wherein packing material is shaped and filled with contents through a pipe having two feed ducts, the steps of:

internally sterilizing the insides of the feed ducts by connecting the outlet ends of the feed ducts to each other to form a closed flow path and passing a sterilizing agent through the closed flow path, and thereafter interrupting the flow path and externally sterilizing the outside of the filling pipe by introducing a sterilizing agent between the pipe and the material which surrounds the pipe and which extends substantially vertically and has a closed lower end, wherein during the internal sterilization the feed ducts are connected to each other by means of a connecting element held in position by means of a safety device which is removed before the connection between the feed ducts in interrupted, the connecting element being detached from the filling pipe to interrupt the flow path, and being placed into the packing material tube.

13. The method in accordance with claim 12, wherein the safety device is removed manually whereupon the lower end of the packing material tube is sealed.

14. In a method for sterilizing parts of a packing machine of the type wherein packing material is shaped and filled with contents through a pipe having two feed ducts, the steps of:

internally sterilizing the insides of the feed ducts by connecting the outlet ends of the feed ducts to each other to form a closed flow path and passing a sterilizing agent through the closed flow path, and thereafter interrupting the flow path and externally sterilizing the outside of the filling pipe by introducing a sterilizing agent between the pipe and the material which surrounds the pipe and which extends substantially vertically and has a closed lower end, wherein during the internal sterilization the feed ducts are connected to each other by means of a connecting element which is detached from the filling pipe when the connecting is interrupted and is placed into the packing material tube, the connecting element being detached through mechanical action from inside of the filling pipe.

* * * * *